United States Patent [19]

Putch

[11] 3,972,546

[45] Aug. 3, 1976

[54] LOCKING ASSEMBLY AND A SEAL ASSEMBLY FOR A WELL

[75] Inventor: Samuel W. Putch, Houston, Tex.

[73] Assignee: Norman A. Nelson, Houston, Tex. ; a part interest

[22] Filed: July 11, 1975

[21] Appl. No.: 595,242

Related U.S. Application Data

[63] Continuation of Ser. No. 449,698, March 11, 1974, abandoned.

[52] U.S. Cl. ..... 285/18; 285/3; 285/175; 285/315; 285/321; 285/330; 166/85

[51] Int. Cl.[2] ..... F16L 35/00

[58] Field of Search ..... 285/3, 4, 18, 175, 39, 285/330, 140, 141, 142, 143, 315, 321, DIG. 29; 166/.6, 85, 86, 87

[56] References Cited

UNITED STATES PATENTS

| | | | |
|---|---|---|---|
| 3,468,559 | 9/1969 | Ahlstone | 285/18 |
| 3,528,686 | 9/1970 | Nelson | 285/143 X |
| 3,807,497 | 4/1974 | Baugh | 285/18 |
| 3,809,158 | 5/1974 | Bond et al. | 285/18 X |
| 3,837,684 | 9/1974 | Hynes | 285/18 X |

*Primary Examiner*—Dave W. Arola
*Attorney, Agent, or Firm*—Fulbright & Jaworski

[57] ABSTRACT

A locking assembly for use in a well for locking a first member to a second tubular well member which includes a locking notch. The assembly includes a locking dog carried by the first member and a locking sleeve positioned for longitudinal movement towards and away from the back side of the locking dog for locking and releasing the dog from the notch. The first member and sleeve are telescopically positioned relative to each other for longitudinal movement with a limited longitudinal lost motion between the first member and sleeve allowing longitudinal movement therebetween for setting and releasing the lock, but preventing disengagement between the first member and the sleeve so that the first member may be retrieved by retrieving the sleeve. A seal assembly connected to the locking assembly for sealing between a wellhead and a casing hanger which is locked in place by the locking assembly and is actuated by a rotative movement with non-threaded engaging means for energizing a resilient seal thereby avoiding remotely engaging threads. The seal assembly includes a left-handed threaded connection for energizing the seal by right-handed rotation thereby avoiding left-hand rotation in the well bore. The seal assembly components are connected by limited longitudinal lost motion connections for preventing disconnection of the parts in the well. The locking assembly and the seal assembly may be retrieved simply by longitudinal movement.

18 Claims, 14 Drawing Figures

LOCKING ASSEMBLY AND A SEAL ASSEMBLY FOR A WELL

This a continuation of application Ser. No. 449,698, filed Mar. 11, 1974 now abandoned.

BACKGROUND OF THE INVENTION

Generally, a fluted casing hanger is used to support casing inside a wellhead. The annulus between the outside of the fluted casing hanger and the inside of the wellhead must be sealed off. Generally, it is old to use a resilient squeeze-type sealing element that is locked into the annulus and squeezed into a sealing relationship. However, generally such seal assemblies have had disadvantages such as being energized by making up threads that have to be engaged remotely, which is difficult when drilling from a floating vessel, or require left-hand rotation for removing the seal assembly which is an undesired operation in a drilling string.

The present invention is directed to an improved locking assembly for securing a seal assembly or other well members in or on a tubular well member having a locking notch. The present invention is also directed to various improvements in a seal assembly in which (1) all operations are performed with a push, pull or right-hand rotation, (2) eliminates all operations requiring left-hand rotation, (3) no threads are required to be engaged or disengaged remotely, (4) the parts are secured together by a limited longitudinal lost motion connection eliminating the possibility of parts of the assembly coming apart while it is being installed or retrieved, (5) the seal assembly may be locked on to the wellhead or onto the casing hanger, (6) the seal assembly is designed to give an actual pressure test of the seal without loading of the seal element by the running tool during the test, and (7) the actuation of the resilient seal is performed by a non-threaded energy connection for imparting rotation thereto.

SUMMARY

One object of the present invention is the provision of a locking assembly for use in a well for locking a first member to a second tubular member which includes a locking notch. The locking assembly is locked and released solely by longitudinal movement by moving a locking sleeve towards and away from a locking dog in which a locking surface such as coacting wedge surfaces are provided between the sleeve and the dog for locking the dog into the notch. The first member and the sleeve are telescopically positioned relative to each other for allowing longitudinal movement for actuation and release of the locking dog but with a limited longitudinal lost motion between the first member and the sleeve to prevent disengagement of the first member from the sleeve but yet allowing rotation between the first member and the sleeve.

A still further object of the present invention is the provision of a seal assembly for sealing between a wellhead and a casing hanger in which one of the wellhead and casing hanger includes a locking notch. The seal assembly is connected to the locking assembly and includes a first member telescopically positioned relative to the sleeve and includes non-threaded engaging connection for imparting rotation to the first member for squeezing a resilient seal thereby allowing actuation of the seal without having to engage threads remotely. A second member is connected to the first member by a left-handed connection so that right-hand rotation of the first member will compress the resilient seal without requiring any undersired left-hand rotation of the running string.

A limited longitudinal lost motion connection is provided between the first member and the sleeve for allowing the locking assembly to be set and released but without danger of the seal assembly becoming separated in the well.

Still a further object of the present invention is the provision of limited longitudinal lost motion connection between the first member and the sleeve which allows rotation between the first member and the sleeve for setting the seal and yet being retained to the lock and allowing the lock and seal assembly to perform their desired functions.

One of the seal assembly members includes a shoulder abutting the bottom of the locking dog for providing a stop for providing a thrusting force against the resilient seal. It is another feature of the present invention that the seal assembly can be retracted and retrieved by longitudinal movement of the locking sleeve and release of the locking dog.

Still a further object of the present invention is the provision of a seal assembly in combination with a locking assembly in which the seal assembly includes first, second and third members. The first member is telescopically positioned relative to the sleeve and includes non-threaded engaging means for imparting rotation to the first member and a limited longitudinal lost motion connection is provided between the first member and the sleeve which allows rotation between the first member and the sleeve. Either the first or second member has a shoulder abutting the bottom of the locking dog, and a left-handed threaded connection is provided between the first and second members whereby right-hand rotation of the first member moves the non-abutting member downwardly for setting a resilient seal. A limited longitudinal lost motion connection is provided between the third member and one of the first and second members which allows rotation to set the seal but prevents detachment of the third member, and means are provided for connecting the third member to the second member allowing relative longitudinal motion therebetween but preventing rotational movement for setting the seal.

Another further object of the present invention is the provision on the third member of a downwardly facing seating shoulder for seating on the casing hanger, and an upwardly facing seating shoulder for receiving a testing tool whereby downward force applied to the testing tool will be applied to the hanger instead of the seal in order to avoid loading of the resilient seal during pressure tests. In addition, a second resilient sealing means is carried by the third member for engagement with the casing hanger.

Yet a still further object of the present invention is the provision of a sealing assembly which can lock onto the casing hanger so that if for any reason the casing hanger is not setting on its seat in the wellhead, the casing annulus may still be securely packed off.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

Figure 2:
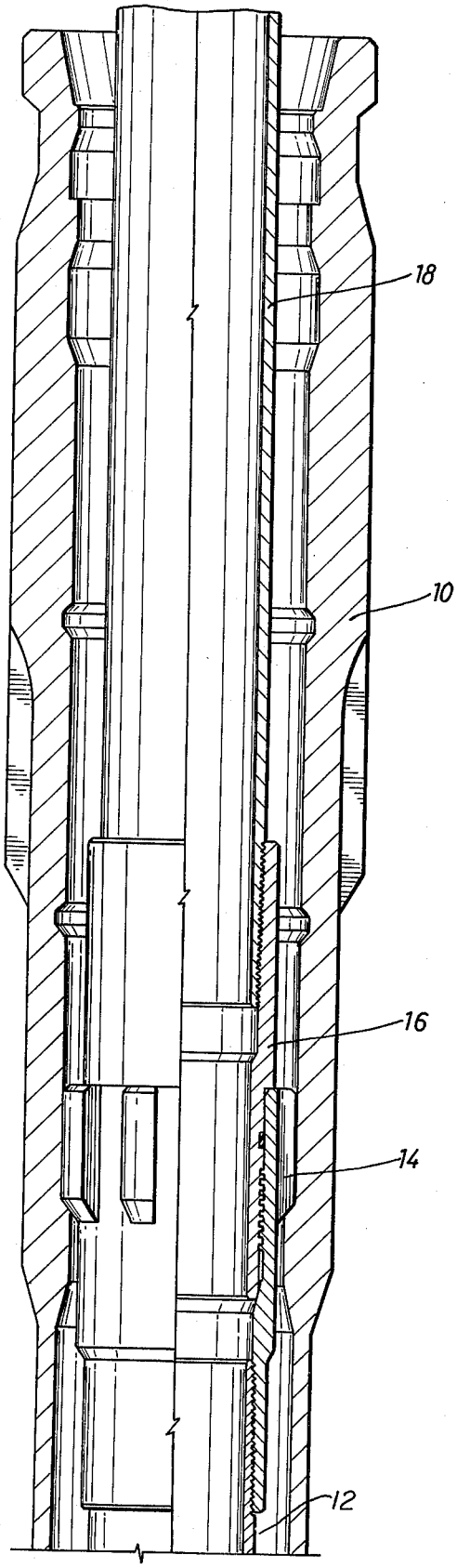
FIG. 2 is an elevational view, in cross section, of a wellhead showing a fluted casing hanger being run with a running tool.

Referring now to the drawings, and particularly to FIG. 2, a conventional wellhead 10 is installed in a well bore and a drill bit (not shown) is lowered through the wellhead 10 and a hole is drilled for the casing. After the hole is drilled, casing 12 is run and supported from a conventional fluted hanger 14 from the wellhead 10 by means of a running tool 16 from casing 18. The casing 12 is conventionally cemented in place by pumping cement down the inside of the casing 18 and casing 12 and chased with a cement plug with the cement going out of the bottom of the casing 12 and up the annulus between the outside of the casing 12 and the inside of the wellhead 10. After cementing the running tool 16 is released from the casing hanger 14 by rotating casing 18 to the right and the running tool 16 is removed.

Figure 4:
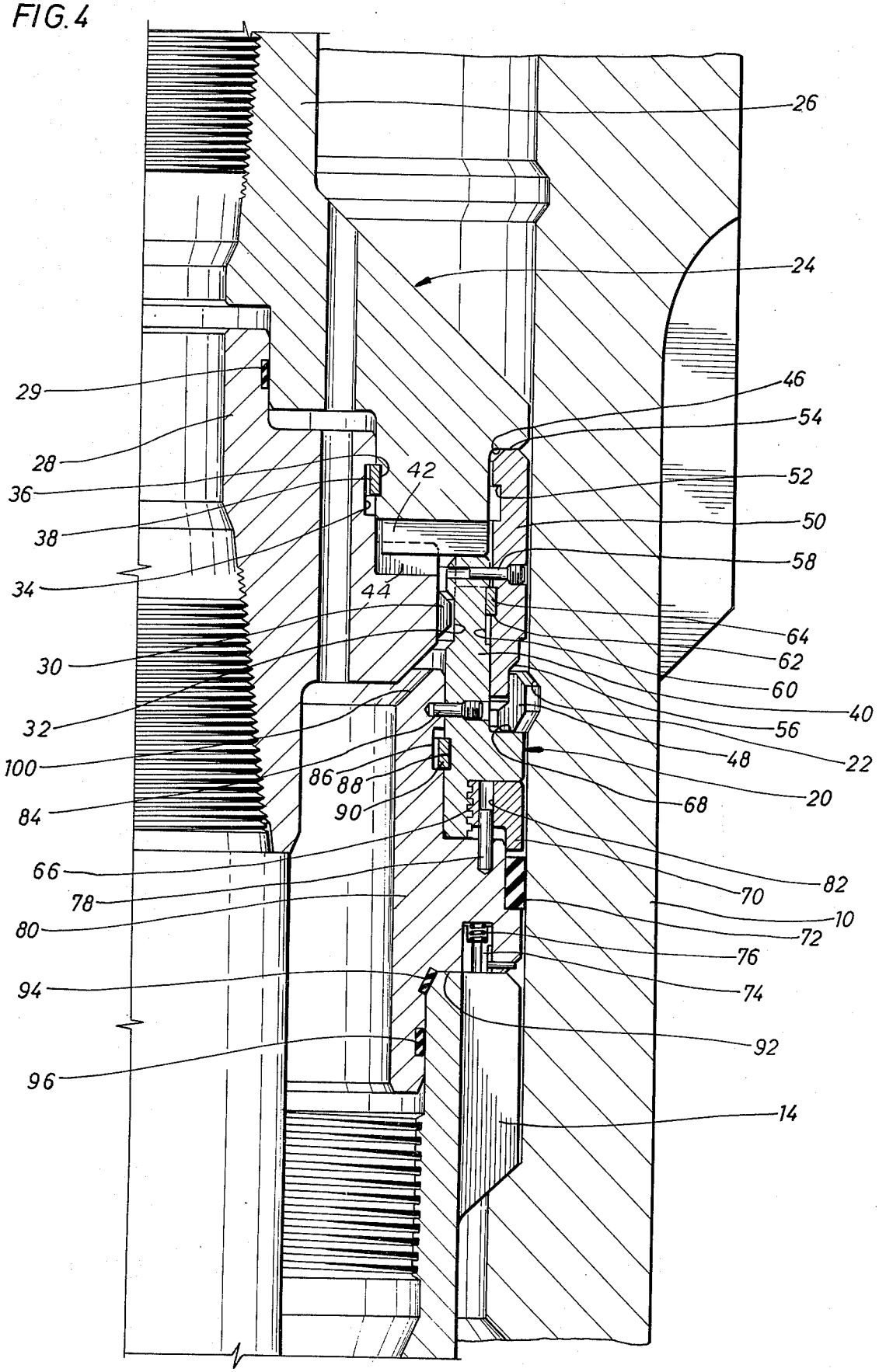
FIG. 4 is an enlarged fragmentary elevational view, in cross section, showing a seal assembly being run, but in the unlocked and unset position.
Figure 5:
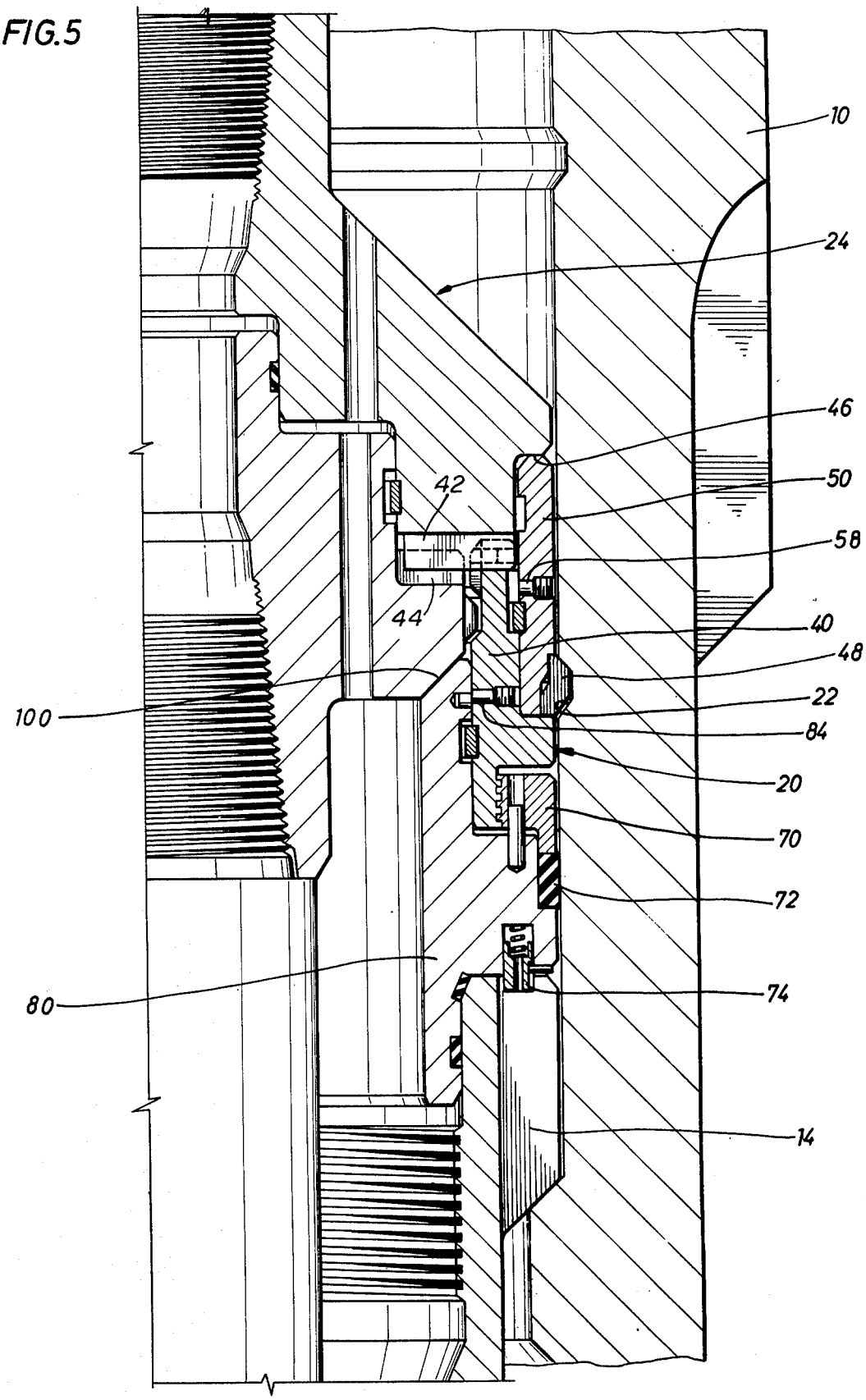
FIG. 5 is an enlarged fragmentary elevational view, in cross section, similar to FIG. 4 showing the seal assembly locked in place and set and being tested with a running and testing tool.
Figure 6:
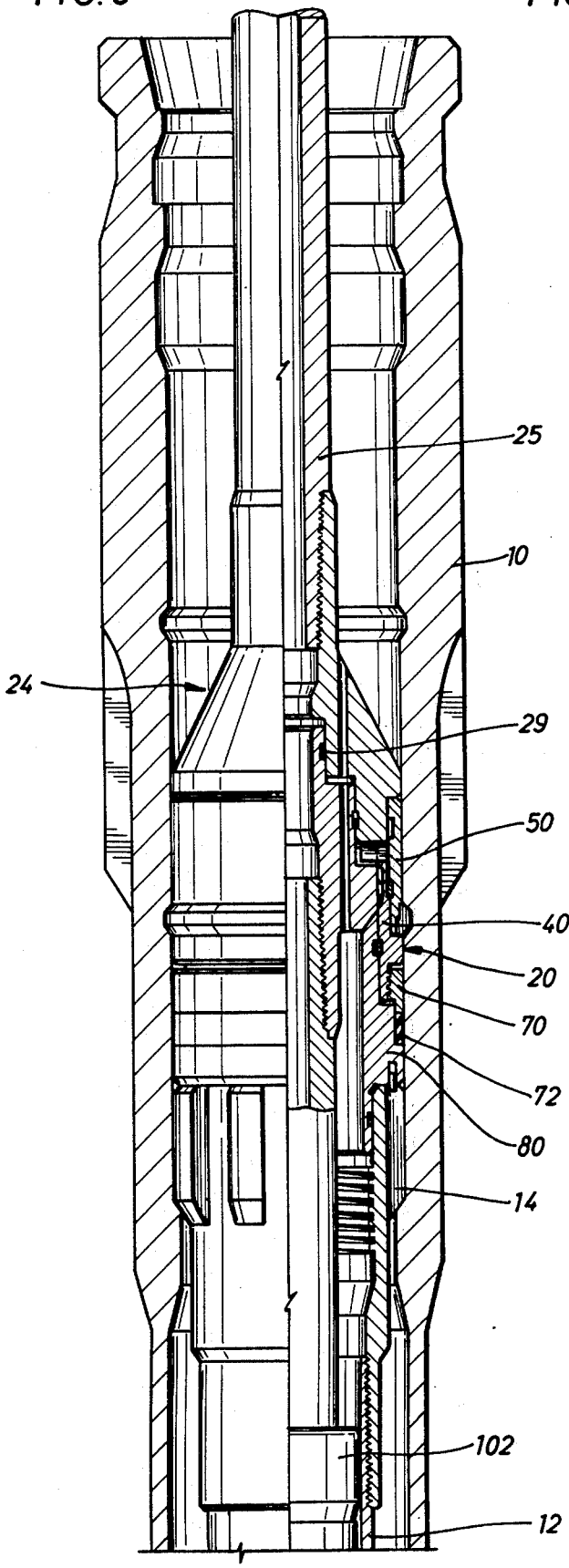
FIG. 6 is an elevational view, in cross section, of a seal assembly locked in place and being tested.

Referring now to FIGS. 4, 5 and 6, the improved seal assembly of the present invention, generally indicated by the reference numeral 20, which includes a locking assembly is installed. While the locking assembly of the present invention will be described in connection with locking the seal assembly 20, for purposes of illustration only, the locking assembly, as will be more fully described hereinafter, is useful for locking a first member to a second tubular well member and its use is not limited to supporting and locking the sealing assembly 20 in place.

Figure 11:
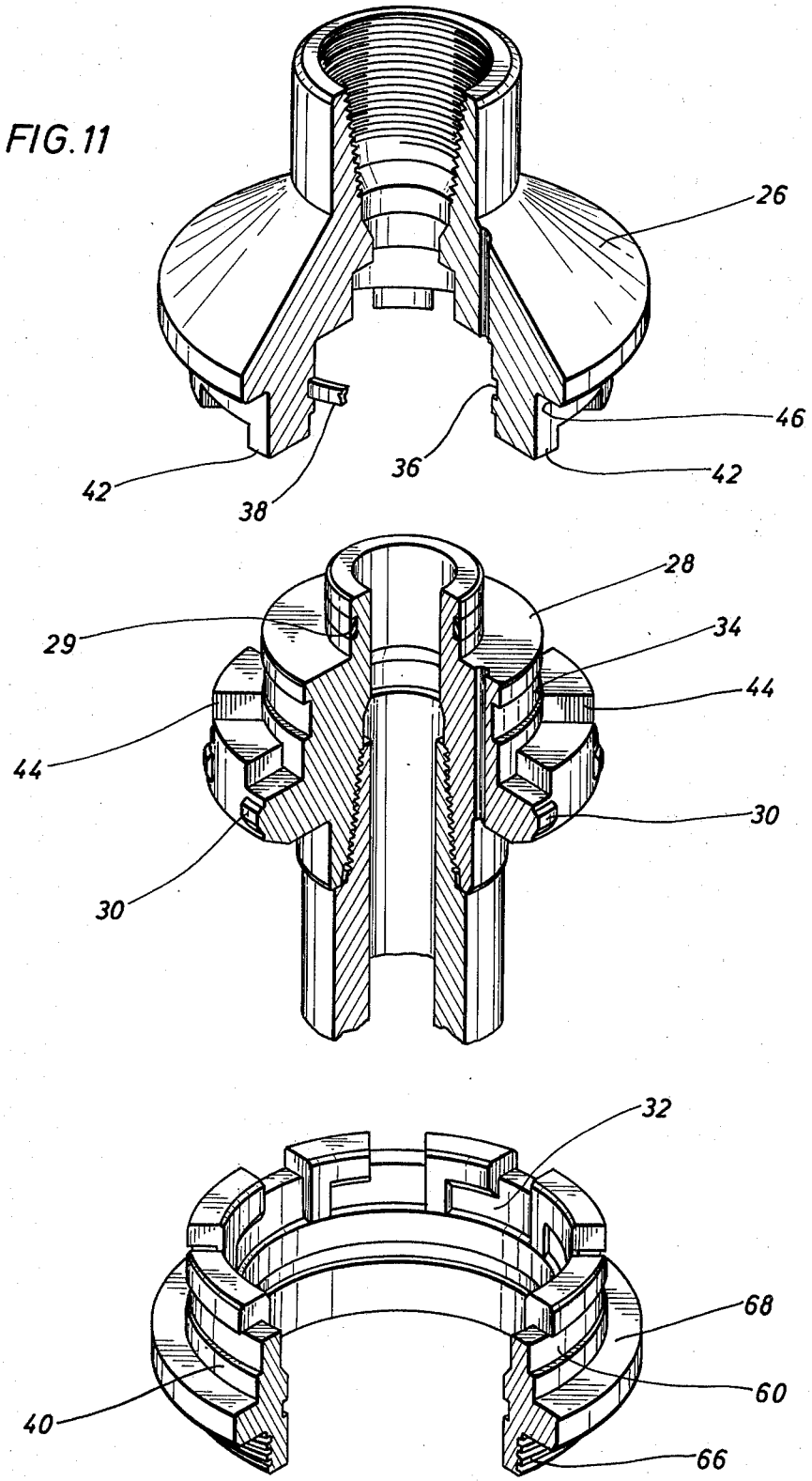
FIG. 11 is an exploded isometric view of the non-threaded connection for imparting rotation to the seal assembly.

The preferred form of the sealing assembly 20, as best seen in FIGS. 4, 5 and 6 is used for sealing off the annulus between the wellhead 10 and the casing hanger 14 by being locked into a locking notch 22 on either the wellhead 10 or the casing hanger 14, here shown as on the wellhead 10. The sealing assembly 20 is run into the wellhead 10 by means of a running and testing tool generally indicated by the reference numeral 24 which includes a first portion 26 supported from a drill pipe 25 and a second portion 28. The seal assembly 20 is supported from the running and test tool 24, as best seen in FIGS. 4 and 11 from a plurality of lugs 30 connected to second portion 28 which are inserted into a non-threaded engaging means such as J slots 32 in a first member 40 of the seal assembly 20 thereby avoiding the use of a threaded connection between the tool 24 and the seal assembly 20. The portions 26 and 28 are longitudinally connected together by a limited lost motion longitudinal connection consisting of an annular slot 34 on portion 28, an annular slot 36 on portion 24 and a ring 38. The portions 26 and 28 include coacting surfaces for imparting rotation therebetween such as splines 42 on portion 26 and coacting grooves 44 on portion 28. In addition, portion 24 includes downwardly directed shoulder 46 for setting a locking sleeve 50, as will be more fully described hereinafter. However, it is to be noted that the tool 24 is adapted to actuate the seal assembly 20 by means of longitudinal push movement and a right-handed non-threaded rotational action and thus avoids threads which must be remotely engaged or disconnected, and avoids left-handed rotation of the drill pipe 25.

The seal assembly 20 is shown in its running position in FIG. 4 in which the parts are shown unlocked and the seal un-energized. The seal assembly 20 includes an annular spring locking dog 48 which is aligned with the locking notch 22 when the seal assembly 20 is seated on the fluted casing hanger 14. A locking sleeve 50 is positioned for longitudinal movement toward and away from the backside of the locking dog 48 and may include a downwardly directed shoulder 52 for engagement with a retrieving tool, which will be described more fully hereinafter, for moving the sleeve upwardly although the shoulder may be omitted and the sleeve moved upwardly by any suitable means such as a spear. The sleeve 50 includes an upwardly directed shoulder 54 for engagement with the shoulder 46 on the tool 24 for moving the sleeve 50 downwardly against the backside of the locking dog 48 whereby the dog 48 is driven into engagement with the locking notch 22 by means of a coacting locking surface between the sleeve 50 and the back side of the dog 48, such as surface 56 on the sleeve 50 which may be a wedge surface, if desired.

Initially, the locking sleeve 50 and the first member 40 are secured together by a shear pin 58 for holding the locking sleeve 50 in the retracted position until it is actuated by the tool 24. The locking mechanism includes a limited longitudinal lost motion connection between the sleeve 50 and the first member 40 such as an annular slot 60 on member 40, an annular slot 62 on sleeve 50 and a ring 64 positioned in the slots 60 and 62. This lost motion connection allows the locking sleeve 50 to be moved into a locking position and retracted therefrom, will allow rotative movement to be imparted to first member 40, and yet prevents disengagement of members 50 and 40, and allows ease of retrieval of the seal assembly 20, as will be more fully described hereinafter, solely by a longitudinal pull on the locking sleeve 50. The first member 40 is telescopically positioned relative to the sleeve 50 to allow both longitudinal and rotational movement therebetween.

The seal assembly 20 includes a second member 70 with a left-handed threaded connection 66 between the first member 40 and the second member 70. The first member 40 includes an abutting shoulder 68 abutting the bottom of the locking dog 48 for longitudinally preventing upward movement of the member 40 when the dog 48 is locked in position in groove 22. Right-hand rotation of the member 40 will move the second member 70 downwardly to squeeze a resilient seal 72 against the wellhead 10. A third member 80 is provided which includes suitable means for resisting rotation such as a pin 74 which is urged downwardly by a spring 76 between the flutes of the fluted casing hanger 14 in order to prevent rotation of the second member 70 when the first member 40 is rotated. In order to prevent rotation of the member 70, means are connected between the third member 80 and the second member 70 allowing relative longitudinal motion therebetween for squeezing the seal 72 but preventing rotational movement between the members 70 and 80 such as pin 78 secured in member 80 and connected to member 70 by a longitudinal slot 82. Preferably, a shear pin 84 is provided between the first member 40 and the third member 80 in order to initially secure the third member 80 to the assembly 20. To allow the resilient seal 72 to be released and retracted by a longitudinal movement of member 70 relative to member 80 without the members becoming detached, a limited lost motion connection is provided between the third member 80 and one of the members 40 and 70 such as 40 by providing a limited longitudinal lost motion connection such as slot 86 in member 80, slot 88 in member 40 and ring 90.

The third member 80 also provides a sealing contact with the top of the fluted casing hanger 14 by either or both of a metal-to-metal seal 92 or one or more resilient seals 94 or 96 which engage the casing hanger 14.

The setting of the seal assembly 20 is best seen from FIGS. 5 and 6 in which the seal assembly 20 is attached to the running and testing tool 24 from drill pipe 25 and set down on top of the fluted casing hanger 14.

Figure 14:
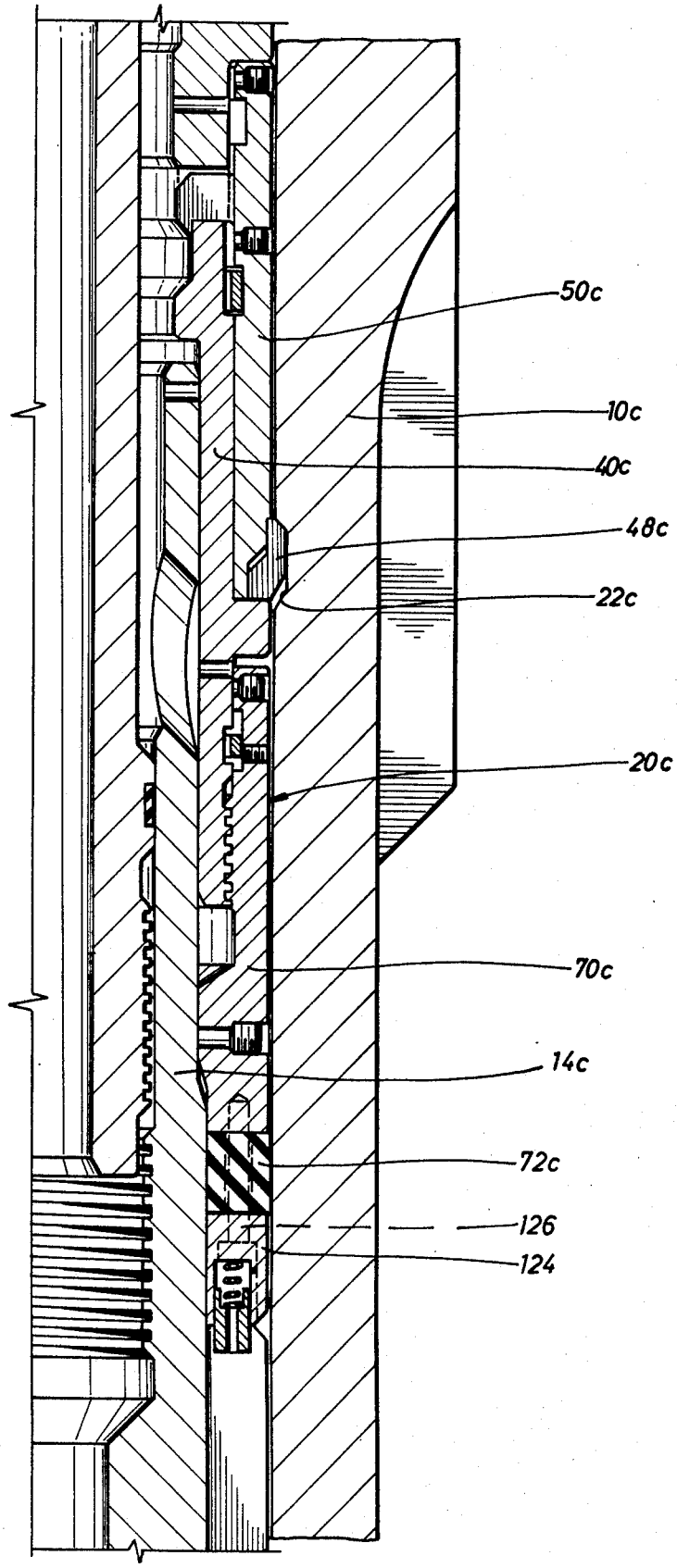
FIG. 14 is an enlarged fragmentary elevational view, in cross section, of still a further modification of the seal assembly of the present invention shown in the locked and set position.

If the spring-loaded pin 74 is not positioned in between flutes of the fluted hanger 14, as shown, the pin 74 will slide off of the top of the flutes and into the space therebetween when rotation is applied to the assembly 20. Setting down on the seal assembly 20 by the tool 24 and rotating causes shoulder 46 on the tool 24 to move sleeve member 50 downwardly shearing pin 58 and moving the sleeve 50 to a position behind the locking dog 48 causing the locking dog 48 to lock in the locking notch 22. At the same time right-hand rotation is applied to the tool 24 whereby rotation is supplied from tool portion 26 to tool portion 28 through the spline 42 and groove 44 connections and in turn to the first member 40 through the spline 42 and J slot grooves 32. This also aligns lugs 30 in grooves 32 to permit separation of tool assembly 24 from pack-off assembly 20. Rotation of member 40 shears pin 84 and screws the second member 70 downward to compress the resilient seal 72, effecting a seal in the annulus between the wellhead 10 and the casing hanger 14 as shown in FIG. 14 or between wellhead 10 and third member 80 as shown in FIG. 5.

It is to be noted that a lower end of the member 80 is setting on the top of the casing hanger 14 and an upper shoulder 100 is provided on the member 80 on which the testing tool 24 is seated and therefore the testing tool does not load the sealing element 72 during the test to falsely give an indication of an increased sealing power of the seal 72 during the test.

To test the seal, blowout preventers (not shown) are closed on the pipe 25, as best seen in FIG. 6, and pressure is pumped down a kill line and into the annulus between the wellhead 10 and the pipe 25 and onto the top of the sealing assembly 20. The testing tool 24 includes a seal 102 in a sealing relationship with the casing. If the pressure builds up and remains steady, the seal 72 is good. If the system is taking fluid and there are no returns through the running string 25 then the pack-off seal 72 is leaking. If the fluid comes up the inside of the running string 25, then either seal 29, between tool portions 26 and 28 or seal 102 is leaking. If the seal assembly 20 tests good, the tool 24 is removed by being pulled out of the well.

Figure 9:
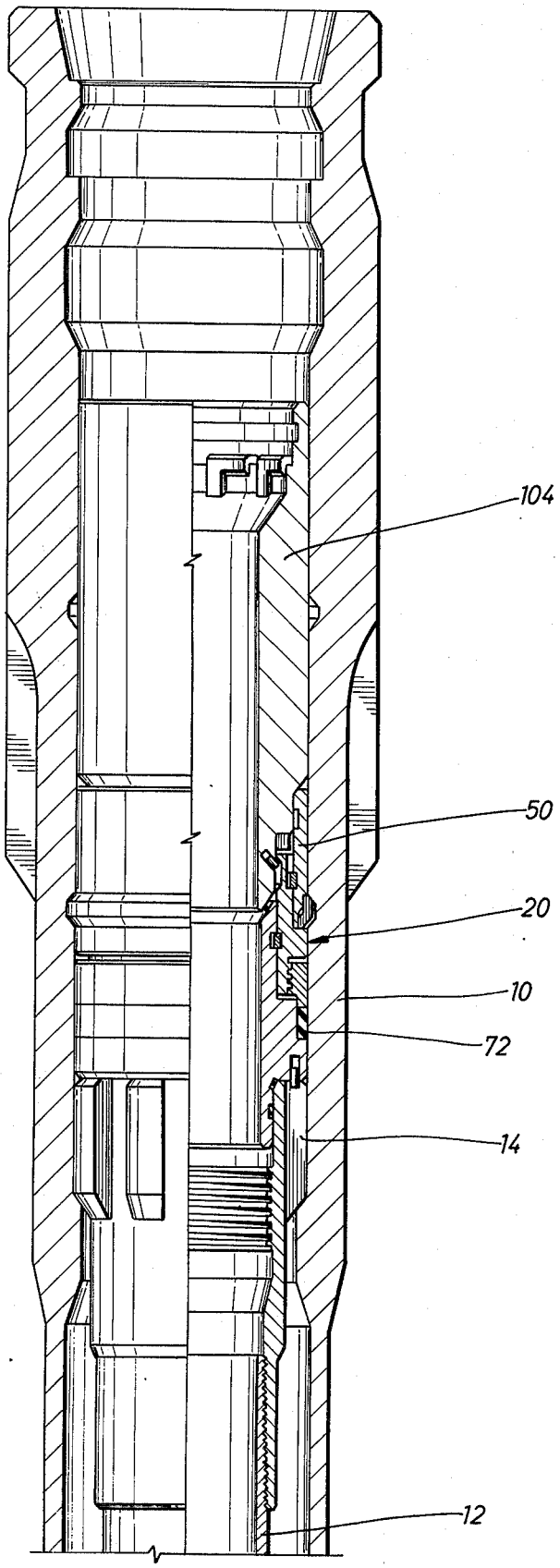
FIG. 9 is an elevational view, in cross section, showing a bowl protector installed on top of the seal assembly.
Figure 10:
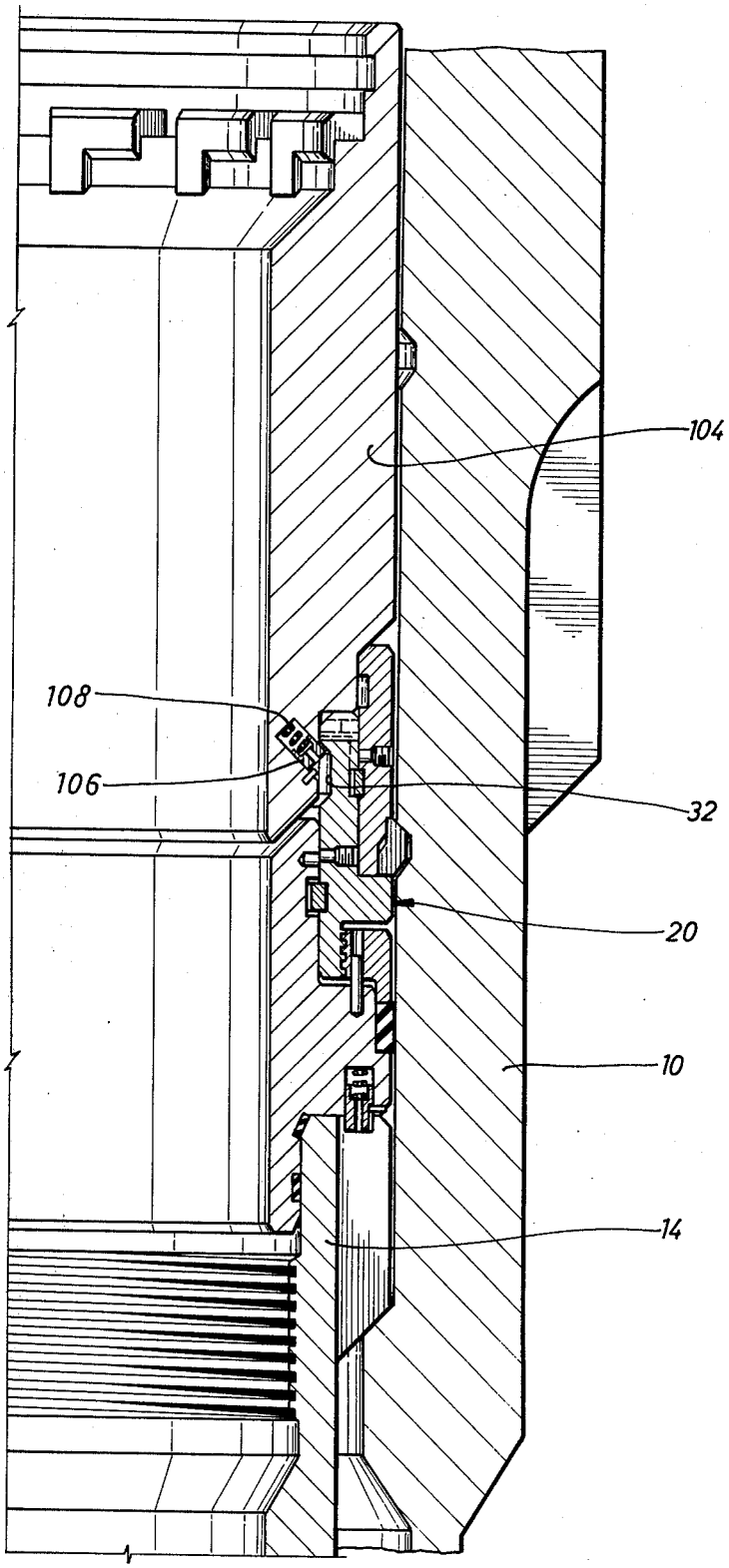
FIG. 10 is an enlarged fragmentary elevational view, in cross section, of FIG. 9 showing the bowl protector locked to the seal assembly.

After testing, and referring to FIGS. 9 and 10, a bowl protector 104 is run into the wellhead 10 before continuing the drilling operation. The bowl protector 104 may be run with the same running tool 24 shown in FIGS. 4, 5 and 6. The bowl protector 104 is lowered down until it sets upon the top of the seal assembly 20 as shown in FIGS. 9 and 10. The tool 24 is rotated to the right until a predetermined amount of torque resistance is met which assures that the protector 104 is in place, and locked down. The locking mechanism, as best seen in FIG. 10, is a pin 106 which is loaded by a spring 108 and pushed outwardly as the bowl protector 104 engages the top of the first member 40 and springs out into the J slots 32 and is locked in place. After the protector 104 is in place, the tool 24 is released by picking up since J-slot attachment is disengaged. The well is now ready to continue drilling.

Figure 1:
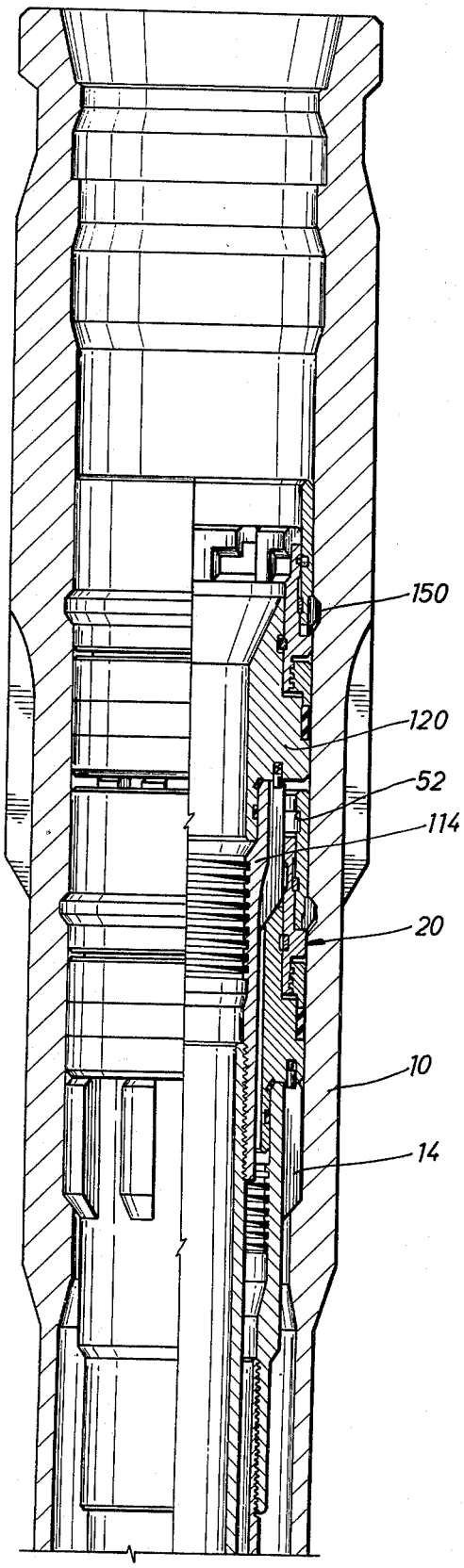
FIG. 1 is a cross-sectional view of a wellhead showing two strings of casing hung inside the head and a sealing assembly installed on each casing hanger.
Figure 7:
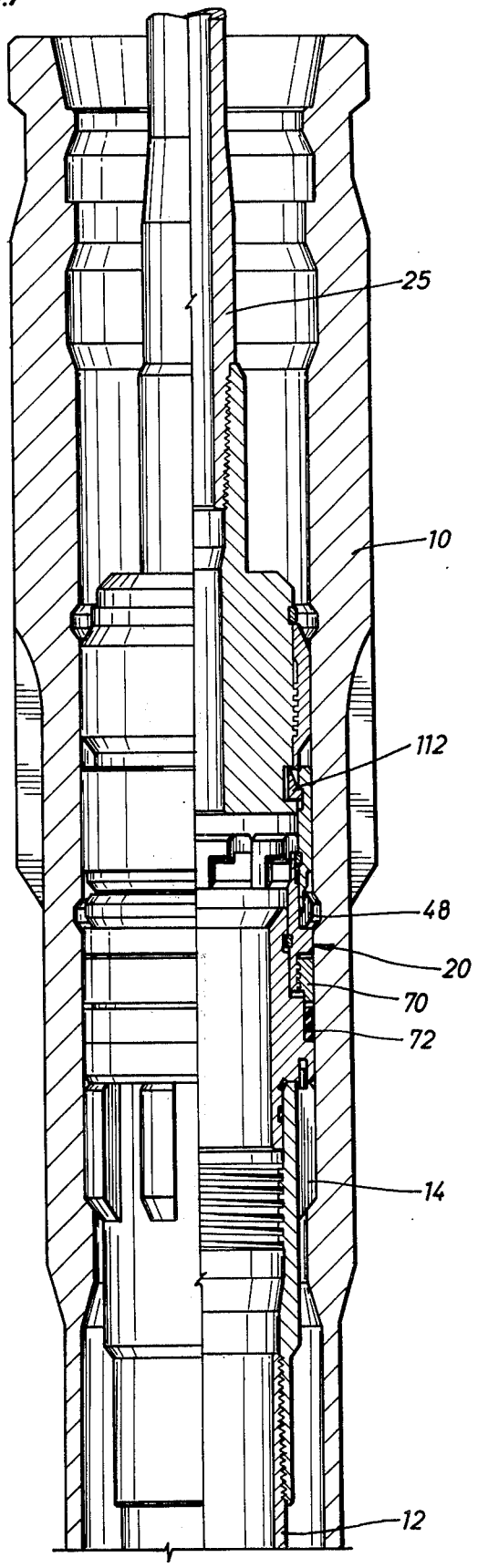
FIG. 7 is an elevational view, in cross section, showing the seal assembly in an unlocked position and being retrieved by a retrieving tool.
Figure 8:
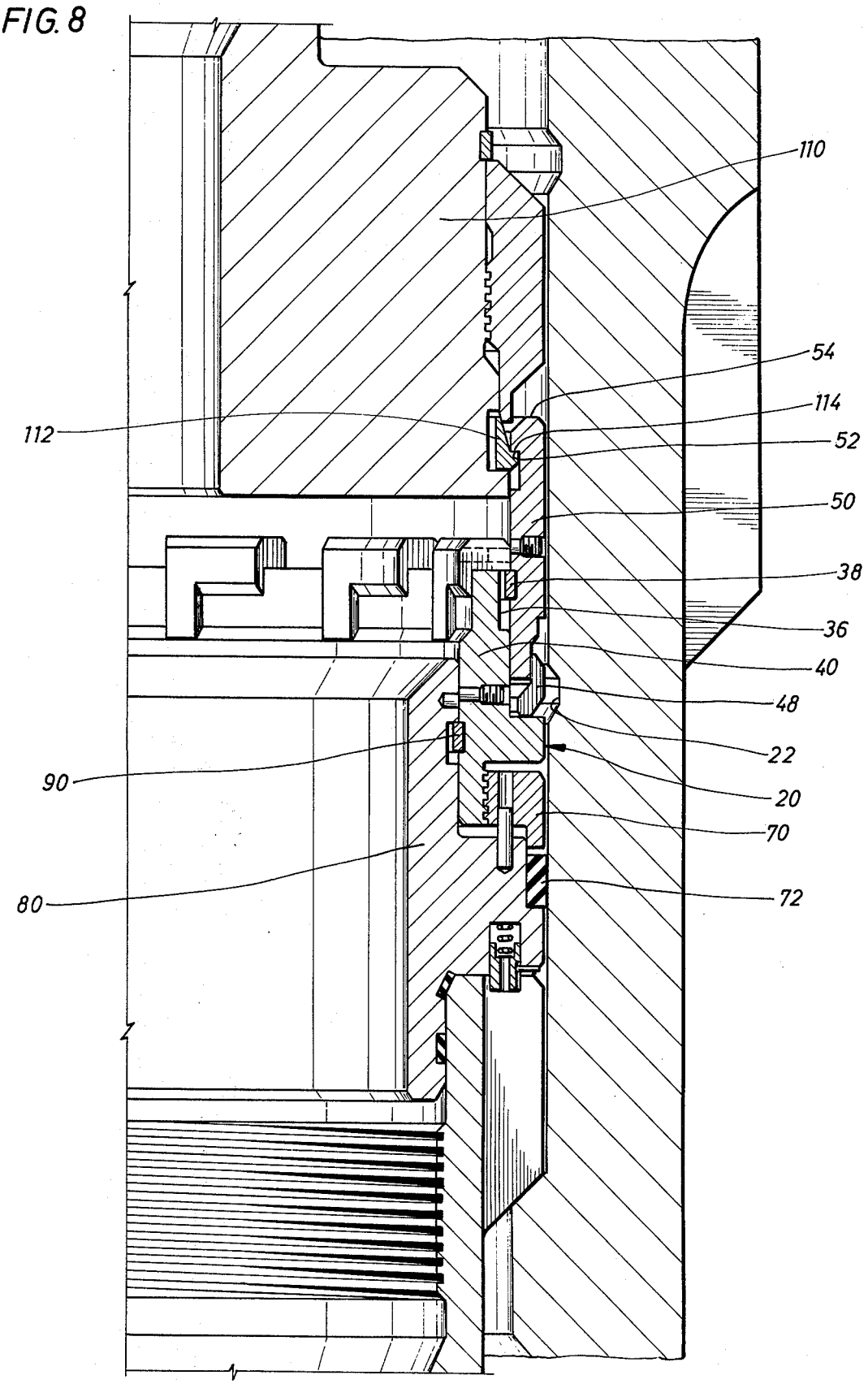
FIG. 8 is an enlarged fragmentary elevational view of FIG. 7 showing the seal assembly being retrieved and in the unlocked and unsealed position.

A drill bit is run down through the bowl protector 104 inside casing 12 and the hole drilled to the desired depth. After removing the bit from the hole, the bowl protector 104 must be removed. With a seal assembly retrieving tool 110, as best seen in FIGS. 7 and 8, attached to drill pipe 25, as will be more fully described hereinafter, the bowl protector 104 is retrieved by simply setting down on top of the bowl protector 104, and pulling it out of the well shearing pin 106. Now, as best seen in FIGS. 1 and 3, a second fluted hanger 114 and seal assembly 120 can be installed with the same procedure as described above for fluted hanger 14 and seal assembly 20.

When the seal assembly 20 needs to be removed from the well, the retrieving tool 110, as best seen in FIGS. 7 and 8, is connected to drill pipe. The retrieving tool 110 includes a resilient grabbing ring 112 having an upwardly directed engaging shoulder 114. When the tool 110 is set down on top of the seal assembly 20, the resilient ring 112 moves inwardly passing over the top shoulder 54 of the sleeve 50 until the engaging shoulder 114 moves downwardly and outwardly into engagement with the downwardly directed shoulder 52. The seal assembly 20 may then be retrieved by a straight longitudinal upward pull. Upward pull by the tool 110 pulls the locking sleeve 50 upwardly and from behind the locking dog 48 thereby allowing the dog 48 to resiliently retract out of the locking notch 22. Further upward movement of the sleeve 50 carries the limited longitudinal lost motion connection between the sleeve 50 and first member 40 upwardly until the ring 38 contacts the upper end of the slot 36 in the member 40. Thereafter, further upward movement of the sleeve 50 longitudinally moves the first member 40 upwardly and in turn carries the second member 70 upwardly thereby releasing the setting pressure on the resilient seal 72 allowing the seal 72 to retract. And still further upward movement of the first member 40 carries the ring 90 in the limited lost motion connection between third member 80 and first member 40 upwardly to contact and carry the third member 80 upwardly. Therefore, the seal assembly 30 is not accidentally backed apart or detached while it is being retrieved and it may be easily removed simply by pulling up on the locking sleeve 50 which releases the lock and allows the resilient seal 72 to be retracted.

Figure 3:
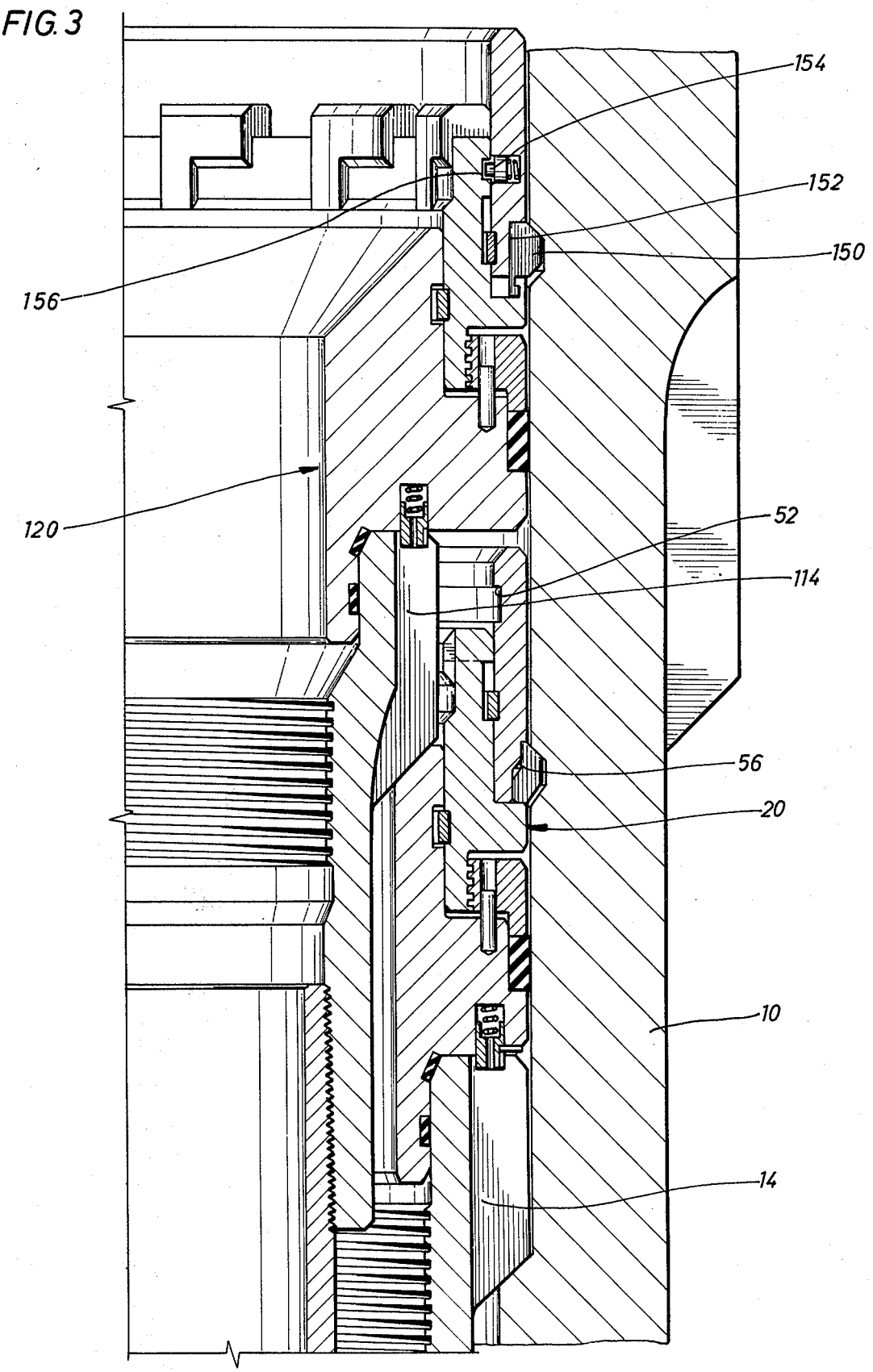
FIG. 3 is an enlarged fragmentary elevational view, in cross section, of FIG. 1 showing the two seal assemblies locked in position on two casing hangers in a wellhead.

Referring to the seal assembly 120, shown in FIG. 3, the shoulder 52, shown in seal assembly 20, has been omitted and the sleeve may be retracted by grabbing the inside diameter thereof with a suitable tool such as a spear. In addition, the seal assembly 120 has omitted the wedging surface from between the sleeve and the locking dog as the dog 150 is spring loaded outwardly and the coacting locking surface 152 on the sleeve need only move behind the dog 150 to lock the dog 150 in place. However, if desired, a spring loaded shear pin 154 may be carried by the sleeve to engage a recess 156 in the first member for releasably holding the sleeve in the locked position when set behind the dog 150.

Figure 12:
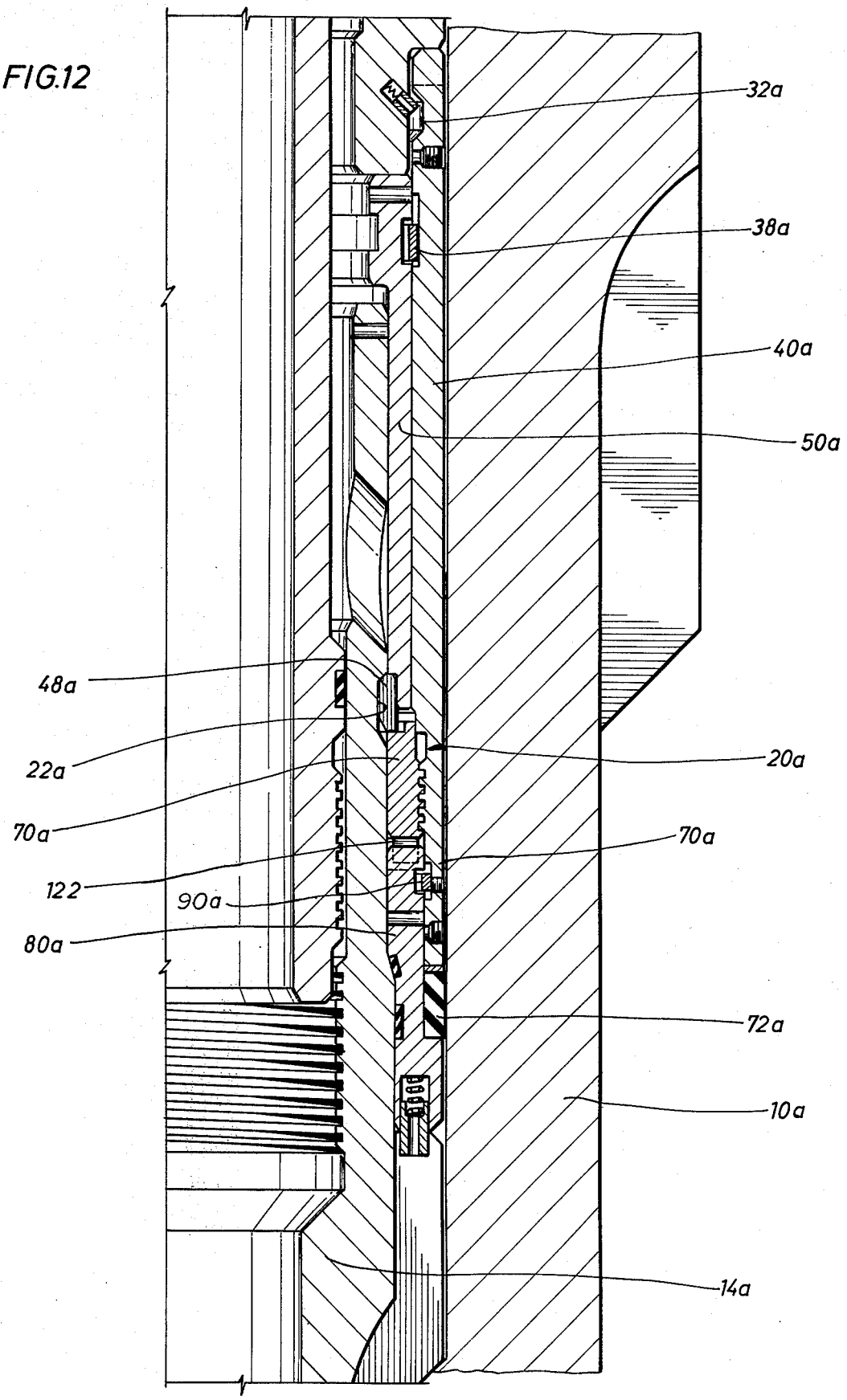
FIG. 12 is an enlarged fragmentary elevational view, in cross section, illustrating a modified type of seal assembly of the present invention.
Figure 13:
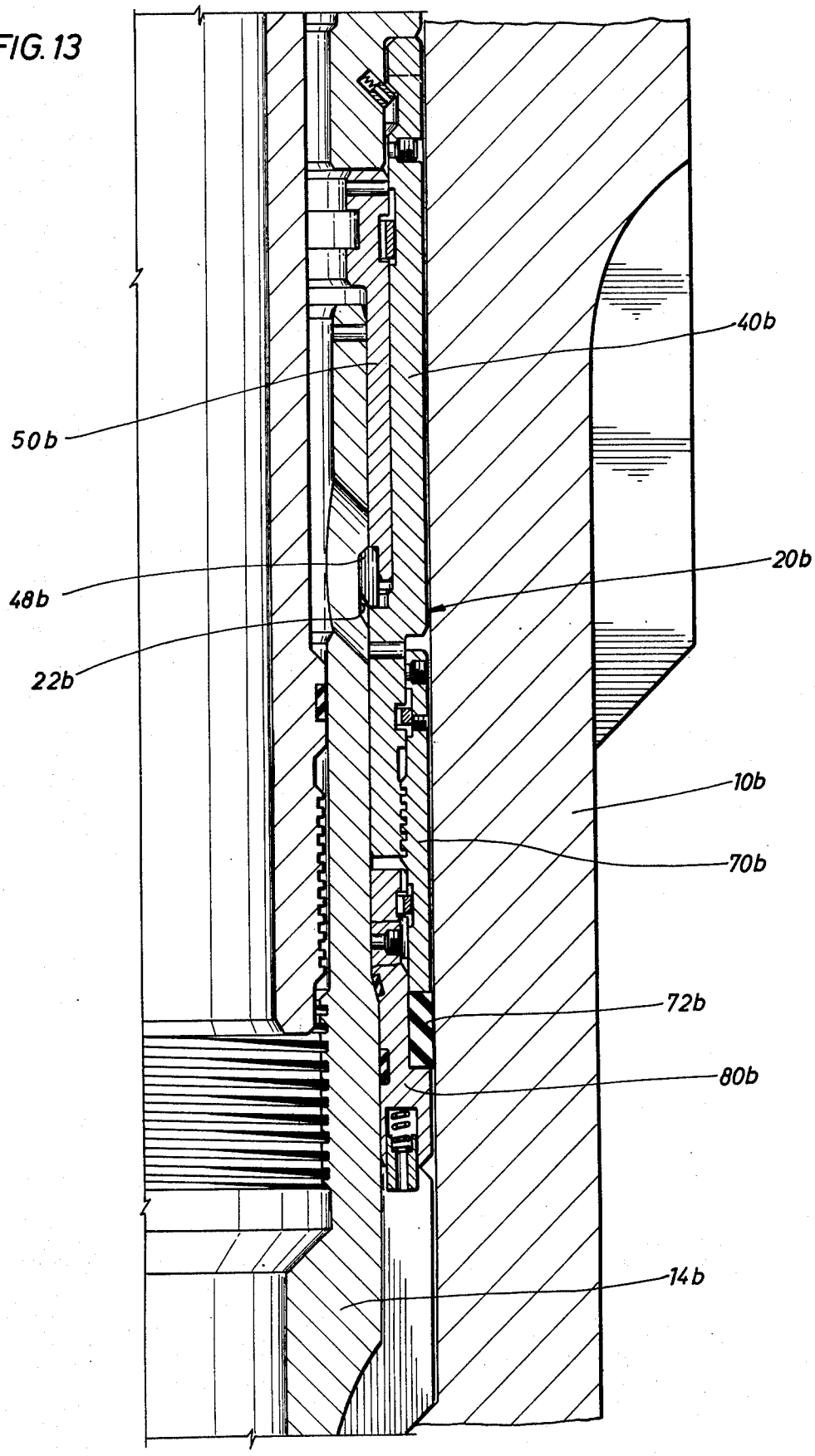
FIG. 13 is an enlarged fragmentary elevational view, in cross section, illustrating another modified type of seal assembly of the present invention in a locked and set position.

Other and further modifications may be made as best seen in FIGS. 12, 13 and 14 wherein like parts to those in FIGS. 1–11 are identified with like numbers with the addition of the suffixes "*a*," "*b*" and "*c*," respectively.

Referring to FIG. 12, the locking notch 22*a* is disposed in the outer periphery of a fluted casing hanger 14*a* instead of in the wellhead 10*a*. If for any reason the casing hanger 14*a* is not seated exactly on its seat in the wellhead 10*a*, the annulus can still be packed off since the locking dog 48*a* may become aligned with the notch 22*a* whether or not the casing hanger 14*a* is seated correctly. In this embodiment, the locking sleeve 50*a* is longitudinally moved downwardly behind the locking dog 48*a* locking the seal assembly 20*a* into position. A right-hand rotation is applied to the first member 40*a* and as the second member 70*a* is abutting the bottom of the dog 48*a*, the first member 40*a* is rotated downwardly to compress and set the resilient seal 72*a*. In this embodiment, the limited longitudinal lost motion connection including the ring 90*a* is between the third member 80*a* and the first member 40*a* and a spline connection 122 is provided between the second member 70*a* and the third member 80*a* which connects the two members relative to each other for allowing relative longitudinal motion but prevents rotational motion therebetween.

In the embodiment of FIG. 13, the locking notch 22*b* is shown on the exterior of the fluted casing hanger 14*b* and this embodiment differs from the embodiment of FIG. 12 generally in that the first member 40*b* includes an abutment under the dog 48*b*. Again, the operation of the assembly 20*b* is similar to the proceeding seal assemblies and the locking sleeve 50*b* is longitudinally moved downwardly to lock behind the locking dog 48*b* after which a right-hand rotational force is imported to the first member 40*b* to move the second member 70*b* downwardly and set the seal 72*b*.

A still further modification is shown in FIG. 14 in which the locking notch 22*c* is in the interior periphery of the wellhead 10*c*. Also in this embodiment the resilient seal 72*c* seals entirely across the annulus between the wellhead 10*c* and the casing hanger 14*c* and the second member 40*c* includes a lower portion 124 which performs the functions of the third member in the previous embodiments of engaging the flutes on the fluted hanger for providing a non-rotative movement of the seal 72*c* and the portion 124 is connected to the second member 70*c* by a limited longitudinal lost motion connection by means of bolts 126 whose heads 128 extend into counterbores 130. Operation of this embodiment proceeds as before the locking sleeve 50*c* being moved downwardly by a longitudinal movement behind the locking dog 48*c* to lock the seal assembly 20*c* into the locking groove 72*c*. Right-hand rotation is then applied to the first member 40*c* which upon rotation moves the second member 70*c* downwardly compressing the resilient seal 22*c* against the lower member portion 124. Again, the seal assembly 20*c* may be removed solely by a longitudinal upward pull on the locking sleeve 50*c*.

The present invention, therefore, is well adapted to carry out the objects and attain the ends and advantages mentioned as well as others inherent therein. While presently preferred embodiments of the invention are given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. A seal assembly for sealing between a wellhead and a casing hanger in which one of the wellhead and casing hanger includes a locking notch comprising, a locking dog for locking in said locking notch, a locking sleeve positioned for longitudinal movement toward and away from the backside of the locking dog for locking and releasing the dog from said notch, said sleeve including means on said sleeve for longitudinally moving the sleeve toward and away from the locking dog, a coacting locking surface between said sleeve and said dog, a first member telescopically positioned relative to said sleeve and including non-threaded engaging means for imparting rotation to said first member, limited longitudinal lost motion means connected between the first member and the sleeve which allows rotation between the first member and the sleeve, a second member, one of the first and second members having a shoulder abutting the bottom of the locking dog, seal means positioned adjacent one of the members for sealing against the wellhead, and a left-handed threaded connection between the first and second members whereby right-hand rotation of the first member sets said seal.

2. The apparatus of claim 1 including, a third member positioned against the bottom of the seal, and limited longitudinal lost motion means which allows rotation between the third member and one of the first and second members.

3. The apparatus of claim 2 including second seal means carried by the third member for engagement with the casing hanger.

4. A seal assembly for sealing between a wellhead and a casing hanger in which one of the wellhead and casing hanger includes a locking notch comprising, a locking dog for locking in said locking notch, a locking sleeve positioned for longitudinal movement toward and away from the backside of the locking dog for locking and releasing the dog from said notch, said sleeve including means for moving the sleeve longitudinally toward and away from said dog, a coacting locking surface between said sleeve and said dog, a first member telescopically positioned relative to said sleeve and including nonthreaded engaging means for imparting rotation to said first member, said first member having a shoulder abutting the bottom of the locking dog, limited longitudinal lost motion means between the first member and the sleeve which allows rotation between the first member and the sleeve, a second member threadedly connected to the first member by left-handed threads whereby right-handed rotation of the first member moves the second member downwardly, a third member connected to the first member by limited longitudinal lost motion means which allows rotation between said members, means connecting said third member to the second member allowing relative longitudinal motion therebetween but preventing rotational motion therebetween, and seal means between the third member and the second member.

5. The apparatus of claim 4 wherein, said third member including a downwardly facing seating shoulder for seating on the casing hanger, and an upwardly facing seating shoulder for receiving a testing tool whereby downward forces applied to the testing tool will be applied to the hanger instead of the seal.

6. The apparatus of claim 5 including, second resilient sealing means carried by the third member for engagement with the casing hanger.

7. A seal assembly for sealing between a wellhead and a casing hanger in which one of the wellhead and casing hanger includes a locking notch comprising, a locking dog for locking in said locking notch, a locking sleeve positioned for longitudinal movement toward and away from the backside of the locking dog for locking and releasing the dog from said notch, said sleeve including means for moving the sleeve longitudinally, a coacting locking surface between said sleeve and said dog, a first member telescopically positioned relative to said sleeve and including nonthreaded engaging means for imparting rotation to said first member, limited longitudinal lost motion means between the first member and the sleeve which allows rotation between the first member and the sleeve, a second member threadedly connected to the first member by left-handed threads whereby rigth-handed rotation of the first member moves the first member downwardly, said second member having a shoulder abutting the bottom of the locking dog, a third member connected to the first member by a limited longitudinal lost motion means which allows rotation between the third and first members, means connecting said third member to the second member allowing relative longitudinal motion therebetween but preventing rotational motion therebetween, and seal means located at the bottom of the first member.

8. The apparatus of claim 7 including, second resilient seal means carried by the third member for engagement with the casing hanger.

9. The apparatus of claim 7 wherein said locking notch is in the outer periphery of the casing hanger.

10. A seal assembly for sealing between a wellhead and a casing hanger in which one of the wellhead and casing hanger includes a locking notch comprising, a locking dog for locking in said locking notch, a locking sleeve positioned for longitudinal movement toward and away from the backside of the locking dog for locking and releasing the dog from said notch, said sleeve including a downwardly directed and an upwardly directed shoulder means for moving the sleeve longitudinally upwardly and downwardly, a coacting locking surface between said sleeve and said dog, a first member telescopically positioned relative to said sleeve and including non-threaded engaging means for imparting rotation to said first member, said first member having a shoulder abutting the bottom of the locking dog, limited longitudinal lost motion means connected between the first member and the sleeve allowing rotation between the first member and the sleeve, a second member threadedly connected to the first member by left-handed threads whereby right-handed rotation of the first member moves the second member downwardly, a third member connected to the second member by limited longitudinal lost motion means which allows rotation between the second and third members, means connecting said third member to the second member allowing relative longitudinal motion therebetween but preventing rotational motion therebetween, and resilient seal means between the third member and the second member.

11. The apparatus of claim 10 including, second resilient seal means carried by the third member for engagement with the casing hanger.

12. The apparatus of claim 10 wherein the locking notch is in the outer periphery of the casing hanger.

13. A seal assembly for sealing between a wellhead and a casing hanger in which one of the wellhead and casing hanger includes a locking notch comprising, a locking dog for locking in said locking notch, a locking sleeve positioned for longitudinal movement toward and away from the backside of the locking dog for locking and releasing the dog from said notch, said sleeve including means for moving the sleeve longitudinally relative to the locking dog, a coacting locking surface between said sleeve and said dog, first, second and third members, said first member telescopically positioned relative to said sleeve, and including non-threaded engaging means for imparting rotation to said first member, limited longitudinal lost motion means connected between the first member and the sleeve which allows rotation between the first member and the sleeve, one of the first and second members having a shoulder abutting the bottom of the locking dog, a left-handed threaded connection between the first and second members whereby right-hand rotation of the first member moves the non-abutting member downwardly, limited longitudinal lost motion means connected between the third member and one of the first and second members which allows rotation between the third member and said one member, resilient seal means carried by one of the members in the downward path of movement of the non-abutting member, and means connecting said third member to the second member allowing relative longitudinal motion therebetween but preventing rotational motion therebetween.

14. A seal assembly for sealing between a wellhead and a casing hanger in which one of the wellhead and casing hanger includes a locking notch comprising, a locking dog for locking in said locking notch, a locking sleeve positioned for longitudinal movement toward and away from the backside of the locking dog for locking and releasing the dog from said notch, said sleeve including means for moving the sleeve longitudinally, a coacting locking surface between said sleeve and said dog, a first member telescopically positioned relative to said sleeve and including non-threaded engaging means for imparting rotation to said first member, said first member having a shoulder abutting the bottom of the locking dog, limited longitudinal lost motion means connected between the first member and the sleeve allowing rotation between the first member and the sleeve, a second member threadedly connected to the first member by left-handed threads whereby right-handed rotation of the first member moves the second member downwardly, a limited longitudinal lost motion means connected between the first and second members which allows rotation between the first and second members, and resilient seal means carried by the second member.

15. A locking assembly for locking a first tubular member to a second tubular member which includes a locking notch comprising, a locking dog carried by the first member, a locking sleeve positioned for longitudinal movement toward and away from the backside of the locking dog for locking and releasing the dog from said notch, said sleeve including means for longitudinally moving the sleeve toward and away from the locking dog, a coacting locking surface between said sleeve and said dog, said first member telescopically positioned relative to said sleeve and including non-threaded engaging means for imparting rotation to said first member, limited longitudinal lost motion means connected between the first member and the sleeve allowing longitudinal movement between the first member and the sleeve but preventing disengagement between the first member and the sleeve, said lost motion connection allowing complete rotational movement between the first member and the sleeve, a second member, one of the first and second members having a shoulder abutting the bottom of the locking dog, and a threaded connection between the first and second members whereby rotation of the first member longitudinally moves the second member.

16. A seal assembly for sealing between a wellhead and a casing hanger in which one of the wellhead and casing hanger includes a locking notch comprising, a locking dog for locking in said locking notch, a locking sleeve positioned for longitudinal movement toward and away from the backside of the locking dog for locking and releasing the dog from said notch, said sleeve including means on said sleeve for longitudinally moving the sleeve toward and away from the locking dog, a coacting locking surface between said sleeve and said dog, a first member telescopically positioned relative to said sleeve and including non-threaded engaging means for imparting rotation to said first member, limited longitudinal lost motion means between the first member and the sleeve which allows longitudinal movement between the first member and the sleeve but prevents disconnection between the first member and the sleeve, a second member, one of the first and second members having a shoulder abutting the bottom of the locking dog, seal means positioned adjacent one of the members for sealing against the wellhead, and a threaded connection between the first and second members whereby rotation of the first member sets said seal.

17. The apparatus of claim 16 including, a third member positioned against the bottom of the seal, and limited longitudinal lost motion means between the second member and the third member which allows limited longitudinal movement between the second member and the third member but prevents disconnection of the third member from the second member.

18. A sealing assembly for sealing between a wellhead and a casing hanger in which the wellhead includes a locking notch comprising, a locking dog for locking in said locking notch, a locking sleeve positioned for longitudinal movement toward and away from the backside of the locking dog for locking and releasing the dog from said notch, said sleeve including means for moving the sleeve longitudinally toward and away from said dog, a coacting locking surface between said sleeve and said dog, a first member telescopically positioned relative to said sleeve and including non-threaded engaging means for imparting rotation to said first member, said first member having a shoulder abutting the bottom of the locking dog, limited longitudinal lost motion means between the first member and the sleeve which allows limited longitudinal movement between the first member and the sleeve but prevents disconnection between the first member and the sleeve, a second member threadably connected to the first member by threads whereby rotation of the first member moves the second member downwardly, a third member connected to the second member by limited longitudinal lost motion means which allows limited longitudinal lost motion between said second and third members but prevents disconnection of the third member from the second member, seal means between the second member and the third member, and means for engaging the casing hanger for preventing rotation of the second and third members.

* * * * *

UNITED STATES PATENT OFFICE

CERTIFICATE OF CORRECTION

PATENT NO. : 3,972,546
DATED : August 3, 1976
INVENTOR(S) : Samuel W. Putch

It is certified that error appears in the above-identified patent and that said Letters Patent are hereby corrected as shown below:

Delete the drawing on the face of the patent, and substitute the attached drawing therefor:

Signed and Sealed this
Ninth Day of November 1976

[SEAL]

*Attest:*

RUTH C. MASON
*Attesting Officer*

C. MARSHALL DANN
*Commissioner of Patents and Trademarks*

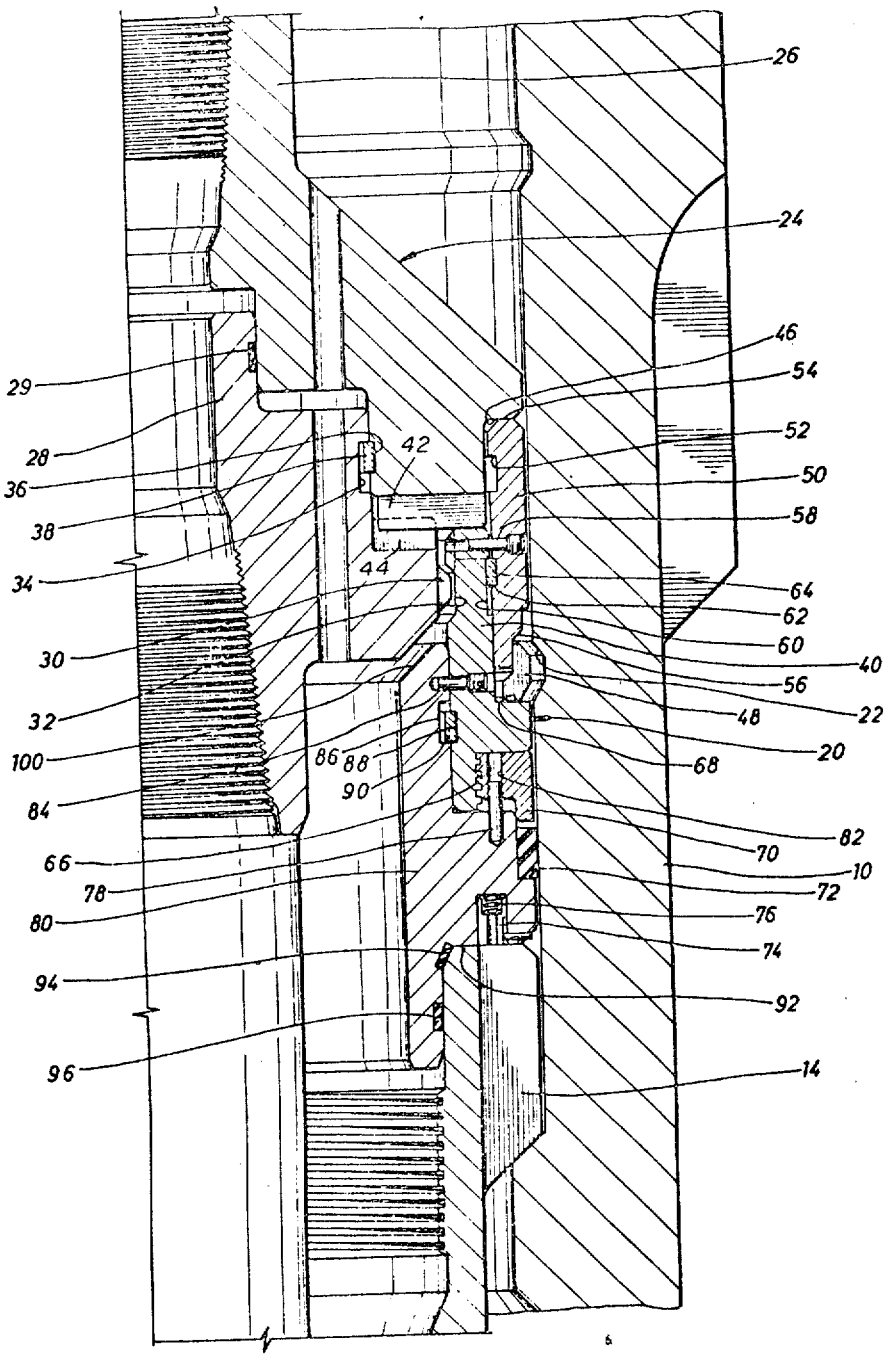
26
24
46
54
52
50
58
64
62
60
40
56
48
22
20
68
82
70
10
72
76
74
92
14
29
28
36
38
34
30
32
100
84
66
78
80
94
96
42
44
86
88
90